United States Patent [19]

Branovich et al.

[11] Patent Number: 4,840,767

[45] Date of Patent: Jun. 20, 1989

[54] METHOD OF MAKING A CATHODE FROM TUNGSTEN AND IRIDIUM POWDERS USING A BARIUM IRIDIATE FORMED FROM BARIUM PEROXIDE AND IRIDIUM OXIDE AS THE IMPREGNANT

[75] Inventors: Louis E. Branovich, Howell Township, Monmouth County; Gerard L. Freeman, Freehold Township, Monmouth County; Bernard Smith, Ocean; Donald W. Eckart, Wall Township, Monmouth County, all of N.J.

[73] Assignee: The United States of America as represented by the Secretary of the Army, Washington, D.C.

[21] Appl. No.: 252,945

[22] Filed: Oct. 3, 1988

[51] Int. Cl.[4] ..... G22F 3/26

[52] U.S. Cl. ..... 419/27; 419/28; 419/29; 419/33; 419/39; 419/54; 419/55; 419/58

[58] Field of Search ..... 204/292; 419/27, 28, 419/29, 33, 39, 54, 55, 58

[56] References Cited

U.S. PATENT DOCUMENTS

| | | | |
|---|---|---|---|
| 4,126,451 | 11/1978 | Nayar | 419/60 |
| 4,324,588 | 4/1982 | Zysk | 419/28 |
| 4,325,734 | 4/1982 | Burrage et al. | 419/60 |
| 4,444,718 | 4/1984 | Smith et al. | 419/36 |
| 4,585,618 | 4/1986 | Fresnel et al. | 419/34 |
| 4,767,372 | 8/1988 | Bossert et al. | 419/2 |

*Primary Examiner*—Stephen J. Lechert, Jr.
*Attorney, Agent, or Firm*—Sheldon Kanars; Roy E. Gordon

[57] ABSTRACT

A cathode is made from a mixture of tungsten and iridium powders using a barium iridiate formed from barium peroxide and iridium oxide as the impregnant.

8 Claims, No Drawings

METHOD OF MAKING A CATHODE FROM TUNGSTEN AND IRIDIUM POWDERS USING A BARIUM IRIDIATE FORMED FROM BARIUM PEROXIDE AND IRIDIUM OXIDE AS THE IMPREGNANT

The invention described herein may be manufactured, used and licensed by or for the Government for governmental purposes without the payment to us of any royalties thereon.

This invention relates in general to a method of making a long life high current density cathode and in particular, to a method of making such a cathode from a mixture of tungsten and iridium powders using a barium iridiate formed from barium peroxide and iridium oxide as the impregnant.

BACKGROUND OF THE INVENTION

In U.S. patent application Ser. No. 204,327 filed June 9, 1988, for "Method of Making a Cathode From Tungsten and Iridium Powders Using a Barium Peroxide Containing Material as the Impregnant" by L. E. Branovich, G. L. Freeman, B. Smith, and D. W. Eckart and assigned to a common assignee and with which this application is copending, there is described and claimed a method of making a long life high density cathode that uses as the impregnant barium peroxide alone, or a mixture of barium peroxide with iridium, or a mixture of barium peroxide with osmium, or a mixture of barium peroxide with rhodium. Although desirable in many aspects, the difficulty with the method of that invention is that the chemical reaction is not rapid enough.

SUMMARY OF THE INVENTION

The general object of this invention is to provide an improved method of making a long life high current density cathode. A more particular object of the invention is to provide such a method that will be rapid and in which lower temperatures can be used.

It has now been found that such a method can be provided by making such a cathode from a mixture of tungsten and iridium powders using a barium iridiate formed from barium peroxide and iridium oxide as the impregnant.

More particularly, according to the invention, such a rapid method is obtained by reacting barium peroxide ($BaO_2$) with iridium oxide ($IrO_2$) in a molar ratio of $BaO_2$ to $IrO_2$ of 1:1, 2:1, and 4:1 to form the corresponding barium iridiates $BaIrO_3$, $Ba_2IrO_4$, and $Ba_4IrO_6$. One or all of these iridiates are excellent impregnants for high current density cathodes.

Depending on the molar mixture, the following iridiates are formed according to the reactions;

(A) $BaO_2+IrO_2BaIrO_3+1/2O_2$ (B) $2BaO_2+IrO_2Ba_2IrO_4+O_2$ (C) $4BaO_2+IrO_2Ba_4IrO_6+2O_2$

DESCRIPTION OF THE PREFERRED EMBODIMENT

A long life high current density cathode is made in the following manner. Tungsten and iridium powders are mixed in a weight ratio of about 65 weight percent tungsten to about 34 weight percent iridium. 1 percent by weight of zirconium hydride activator is added to the mixture and the mixture ball milled for about 8 hours. The ball milled mixture is then pressed into a billet at about 48,000 psi in a die and the billet then sintered at 1800° C. for thirty minutes in dry hydrogen of less than −100 dewpoint. The billet is then backfilled with copper in dry hydrogen at 1500° C., the billet machined to the desired geometry, and the copper then removed by etching in nitric acid. The porous billet is then thoroughly rinsed in deionized water, methanol and then dried. The billet is then impregnated in situ with the barium iridiate, $BaIrO_3$ obtained from the reaction of $BaO_2$ with $IrO_2$ in a 1:1 molar ratio of $BaO_2$ to $IrO_2$ with heating to 1050° C. for about two minutes. After the billet is cooled, loose particles of impregnant are removed from the billet using a jeweler's lathe and fine alumina cloth.

The resulting cathode is then mounted in a test vehicle and activated using standard matrix cathode activation procedures.

In lieu of the tungsten-iridium billet shown in the preferred embodiment, one might also use a tungsten billet.

The reaction of the $BaO_2$ with the $IrO_2$ to form the barium iridiate takes place in situ on the billet. A moly cap may be used to prevent the escape of $BaO/BaO_2$ when the sample is heated under vacuum or hydrogen because of the generation of gaseous oxygen ($O_2$) during chemical mixing due to the reaction $$2BaO_2 \text{ heat } BaO+O_2$$

We wish it to be understood that we do not desire to be limited to the exact details of construction as described for obvious modifications will occur to a person skilled in the art.

What is claimed is:

1. Method of making a cathode for operation in microwave devices from tungsten and iridium powders using a barium iridiate formed from barium peroxide and iridium oxide as the impregnant, said method including the steps of:

(A) mixing the tungsten and iridium powders, (B) adding about 2 percent by weight of an activator to the mixture, (C) ball milling the mixture for about 8 hours, (D) pressing the ball milled mixture into a billet at about 48,000 psi in a die, (E) sintering the billet at about 1800° C. for about thirty minutes in dry hydrogen of less than −100 dewpoint, (F) backfilling the billet with copper in dry hydrogen at about 1500° C., (G) machining the billet to the desired geometry, (H) removing the copper by etching in nitric acid, (I) thoroughly rinsing in deionized water, methanol and then drying, (J) firing the billet in dry hydrogen at about 1400° C. for about 15 minutes, (K) impregnating the billet with a barium iridiate formed in situ from reacting barium peroxide ($BaO_2$) with iridium oxide ($IrO_2$) by firing the billet in a dry hydrogen furnace at a temperature at which the impregnant melts for about two minutes, (L) removing the billet from the furnace after the furnace is cooled, and (M) removing any loose pieces of impregnant from the billet.

2. Method of making a cathode according to claim 1 wherein in step (A), the tungsten and iridium powders are mixed in a weight ratio of about 65 weight percent tungsten to about 34 weight percent iridium.

3. Method of making a cathode according to claim 1 wherein in step (B), the activator is about 1 weight percent zirconium hydride.

4. Method of making a cathode according to claim 1 wherein in step (K), the molar ratio of barium peroxide to iridium oxide may vary from 1:1 to 4:1.

5. Method of making a cathode according to claim 4 wherein in step (K) the molar ratio of barium peroxide to iridium oxide is 1:1.

6. Method of making a cathode according to claim 4 wherein in step (K) the molar ratio of barium peroxide to iridium oxide is 2:1.

7. Method of making a cathode according to claim 4 wherein in step (K), the molar ratio of barium peroxide to iridium oxide is 4:1.

8. Method of making a cathode for operation in microwave devices from tungsten and iridium powders using a barium iridiate formed from one mole of barium peroxide and one mole of iridium oxide as the impregnant, said method including the steps of:

(A) mixing the tungsten and iridium powders in the weight ratio of about 65 weight percent tungsten to about 34 weight percent iridium, (B) adding about 1 percent by weight of zirconium hydride to the mixture, (C) ball milling the mixture for about 8 hours, (D) pressing the ball milled mixture into a billet at about 48,000 psi in a die, (E) sintering the billet at about 1800° C. for about thirty minutes in dry hydrogen of less than −100 dewpoint, (F) backfilling the billet with copper in dry hydrogen at about 1150° C., (G) machining the billet to the desired geometry, (H) removing the copper by etching in nitric acid, (I) thoroughly rinsing in deionized water, methanol and then drying, (J) firing the billet in dry hydrogen at about 1400° C. for about 15 minutes, (K) impregnating the billet with a barium iridiate formed from one mole of barium peroxide and one mole of iridium oxide by firing the billet in a dry hydrogen furnace at about 1050° C. for about two minutes, (L) removing the billet from the furnace after the furnace is cooled, and (M) removing any loose pieces of impregnant from the billet.

* * * * *